US007905708B2

(12) United States Patent
Fan et al.

(10) Patent No.: US 7,905,708 B2
(45) Date of Patent: Mar. 15, 2011

(54) FAN AND IMPELLER THEREOF

(75) Inventors: Jui-Ting Fan, Taoyuan Hsien (TW); Cheng-Shu Yu, Taoyuan Hsien (TW); Peng-Chu Tao, Taoyuan Hsien (TW); Wen-Shi Huang, Taoyuan-Hsien (TW)

(73) Assignee: Delta Electronics Inc., Taoyuan Hsien (TW)

( * ) Notice: Subject to any disclaimer, the term of this patent is extended or adjusted under 35 U.S.C. 154(b) by 476 days.

(21) Appl. No.: 11/604,364

(22) Filed: Nov. 27, 2006

(65) Prior Publication Data

US 2007/0128039 A1 Jun. 7, 2007

(30) Foreign Application Priority Data

Dec. 2, 2005 (TW) ..... 94142388 A

(51) Int. Cl.
*F04D 29/28* (2006.01)

(52) U.S. Cl. ..... 416/178; 416/187; 416/195; 416/203; 417/423.1

(58) Field of Classification Search ..... 417/423.1; 416/178, 182, 187, 190, 195, 196 R, 203
See application file for complete search history.

(56) References Cited

U.S. PATENT DOCUMENTS

| | | | | |
|---|---|---|---|---|
| 1,068,512 | A * | 7/1913 | Ljungstrom | 416/194 |
| 1,618,284 | A * | 2/1927 | Hodgkinson | 416/196 R |
| 1,618,285 | A * | 2/1927 | Kasley | 416/196 R |
| 1,888,795 | A * | 11/1932 | Faber | 416/196 R |
| 4,191,508 | A * | 3/1980 | Kuroda et al. | 416/196 R |
| 4,834,612 | A * | 5/1989 | Lahn et al. | 415/119 |
| 5,971,709 | A * | 10/1999 | Hauser | 416/175 |
| 7,061,758 | B2 * | 6/2006 | Liu et al. | 361/695 |
| 7,399,161 | B2 * | 7/2008 | Kao et al. | 416/187 |
| 2006/0275115 | A1 * | 12/2006 | Wu et al. | 415/206 |

* cited by examiner

*Primary Examiner* — Edward Look
*Assistant Examiner* — Ryan H Ellis
(74) *Attorney, Agent, or Firm* — Birch, Stewart, Kolasch & Birch, LLP

(57) ABSTRACT

A fan comprises an impeller and a motor. The impeller has a hub, a plurality of blades and a plurality of reinforced elements. The blades are disposed around the hub. At least one reinforced element is disposed on the active surfaces of two adjacent blades. The blades and the reinforced elements are integrally formed as a single piece. The motor connects to the impeller for driving it to rotate.

17 Claims, 5 Drawing Sheets

FAN AND IMPELLER THEREOF

CROSS REFERENCE TO RELATED APPLICATIONS

This Non-provisional application claims priority under 35 U.S.C. §119(a) on Patent Application No(s). 094142388 filed in Taiwan, Republic of China on Dec. 2, 2005, the entire contents of which are hereby incorporated by reference.

BACKGROUND OF THE INVENTION

1. Field of Invention

The invention relates to a fan and an impeller thereof and, in particular, to a fan with a reinforced structure and an impeller thereof.

2. Related Art

Since the present electronic products are rapidly developed towards high performance, high frequency, high speed and more compact, the generated heat of the electronic products becomes greater. However, the electronic products may be unstable in the high temperatures, so that the reliability thereof is affected. Thus, the heat dissipation has become an important issue of the present electronic products.

The fan is a common heat dissipating device for the electronic product. As shown in FIG. 1, a conventional impeller 10 mainly includes a plurality of blades 101 and a hub 102. The blades 101 are disposed around the hub 102, and a connecting ring 12 is used to connect the blades 101. The hub 102 is used for accommodating a motor (not shown), which drives the impeller 10 to rotate.

Since the need for heat dissipation is larger, the performance of the fan must be higher. In general, for increasing the airflow quantity, the size of the blades 101 is enlarged. To maintain the strength of the large-sized blades 101, the prior art adopts metal blades or adds a circular rib 13 for strengthening the structure of the blades 101. Herein, the circular rib 13 is disposed around the periphery of the blades 101.

However, the impeller 10 has limited space. In the same capacity, to provide the circular rib 13 makes the blades 101 disposed inwardly, which leads to the reduced active surfaces of blades 101. Thus, the airflow quantity and the air pressure are decreased.

Therefore, it is an important subject to provide a fan and an impeller thereof, which can provide large airflow quantity and have better structure strength.

SUMMARY OF THE INVENTION

In view of the foregoing, the invention is to provide a fan and an impeller thereof that can provide large airflow quantity and have better structure strength.

To achieve the above, a fan of the invention comprises an impeller and a motor. The impeller comprises a hub, a plurality of blades and a plurality of reinforced elements. The blades are disposed around the hub and at least one reinforced element is disposed between active surfaces of two adjacent blades. The blades and the reinforced elements are integrally formed as a single piece. The motor connects to the impeller for driving it to rotate.

To achieve the above, an impeller of the invention comprises a hub, a plurality of blades and a plurality of reinforced elements. The blades are disposed around the hub and at least one reinforced element is disposed between active surfaces of two adjacent blades. The blades and the reinforced elements are integrally formed as a single piece.

As mentioned above, the fan and impeller of the invention have at least one reinforced element on the active surfaces of the adjacent blades. In more detailed, one or more reinforced elements are disposed radially or axially between the adjacent blades. Herein, the reinforced elements can be located in misalignment and be integrally formed as a single piece with the blades to strengthen the structure of the blades. Compared with the prior art, since the reinforced elements are disposed on the active surfaces of the adjacent blades, the blades of the invention are unnecessary to be disposed inwardly under the condition of the same accommodation capacity. Thus, the fan of the invention can have larger blade area for providing larger airflow quantity and air pressure.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
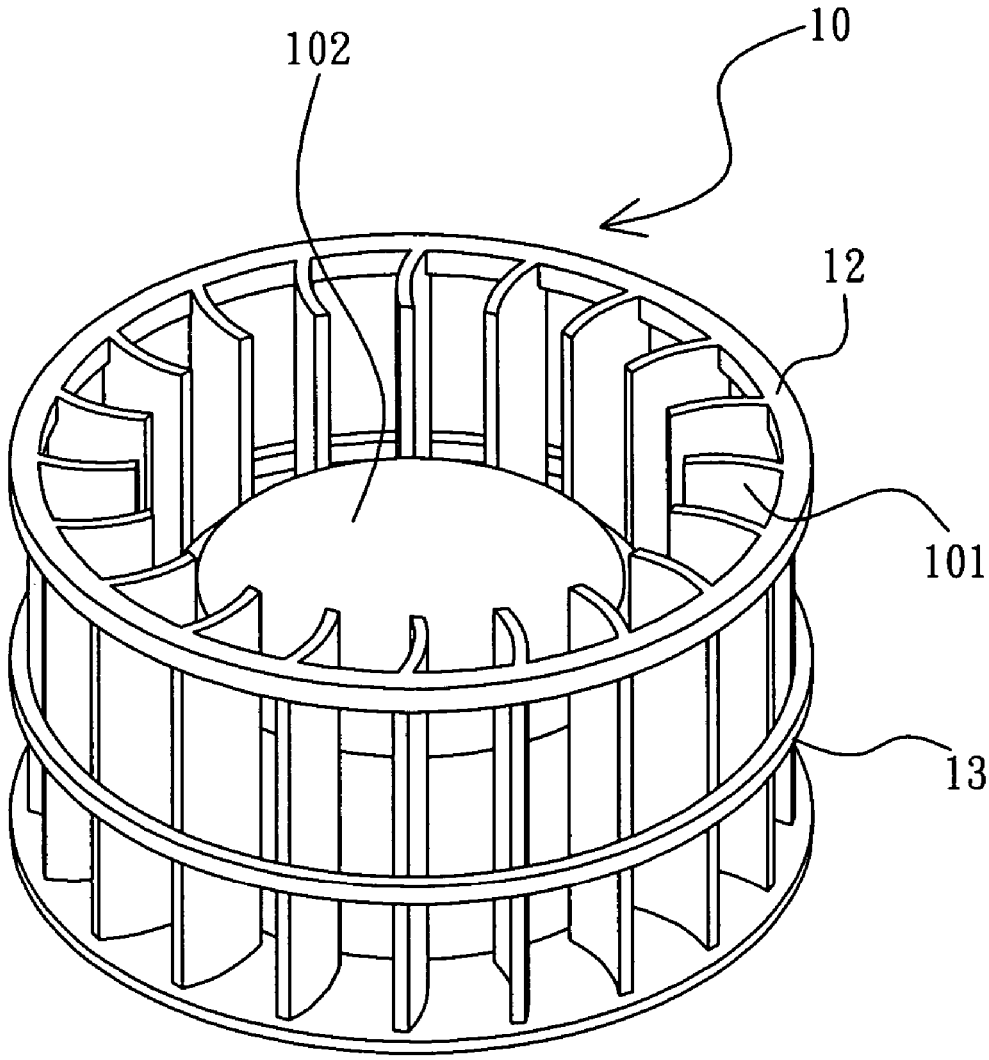
FIG. 1(Prior Art)
FIG. 1 is a schematic illustration showing a conventional impeller with a circular rib.
Figure 2:
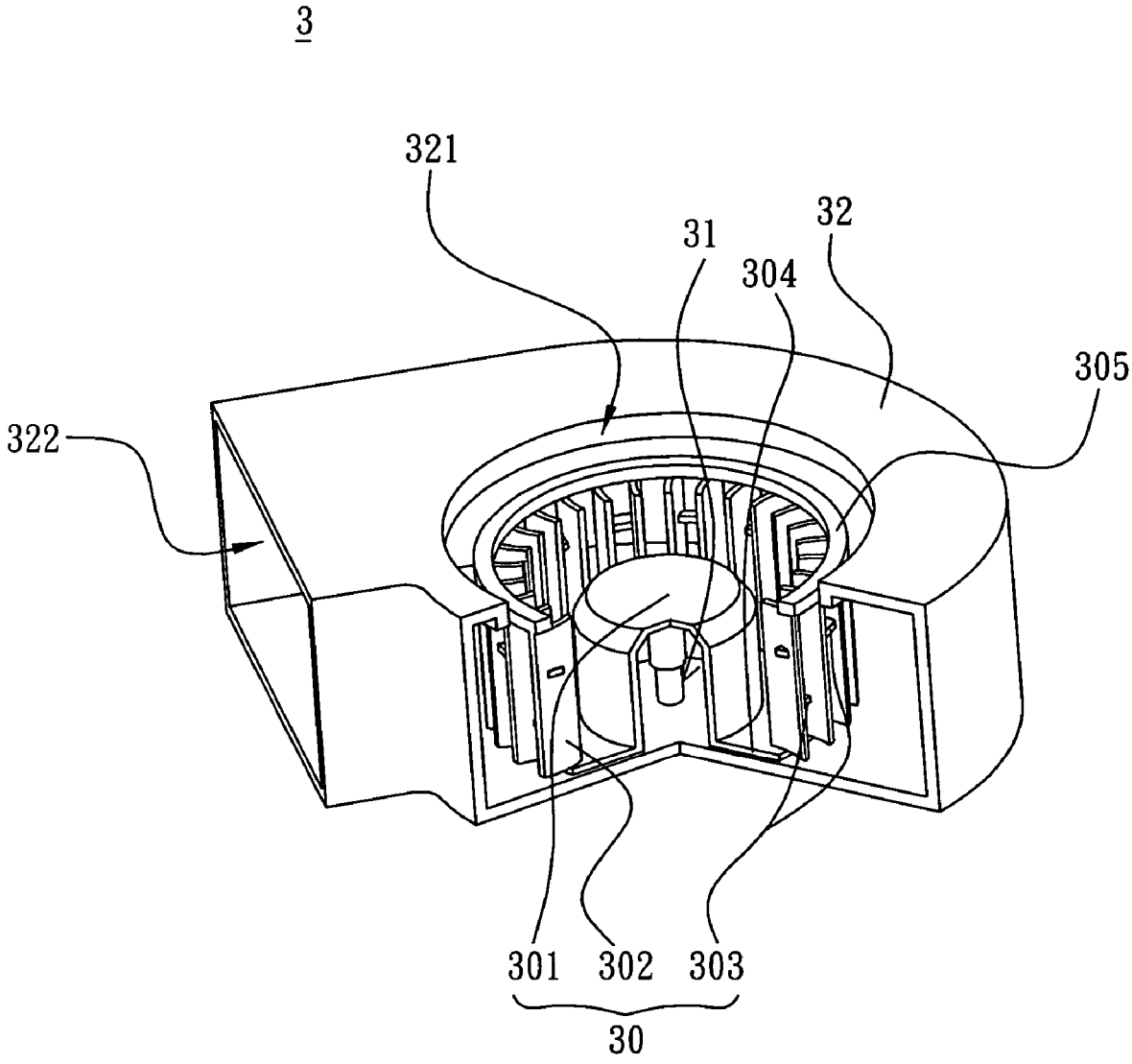
FIG. 2 is a schematic illustration showing a fan according to an embodiment of the invention.

Referring to FIG. 2, a fan 3 according to an embodiment of the invention comprises an impeller 30 and a motor 31. The fan 3 can be a centrifugal fan but this description is not meant to be construed in a limiting sense.

The impeller 30 comprises a hub 301, a plurality of blades 302 and a plurality of reinforced elements 303. The blades 302 are disposed around the hub 301. The blades 302 and the hub 301 can be integrally formed as a single piece. The motor 31 can be accommodated in the hub 301 to drive the impeller 30 to rotate. Besides, the fan 3 may further comprise a fan frame 32, which has at least one inlet 321 and one outlet 322. The impeller 30 is accommodated in the fan frame 32. When the impeller 30 rotates, an airflow is formed to enter from the inlet 321 and exit through the outlet 322.

Figure 3:
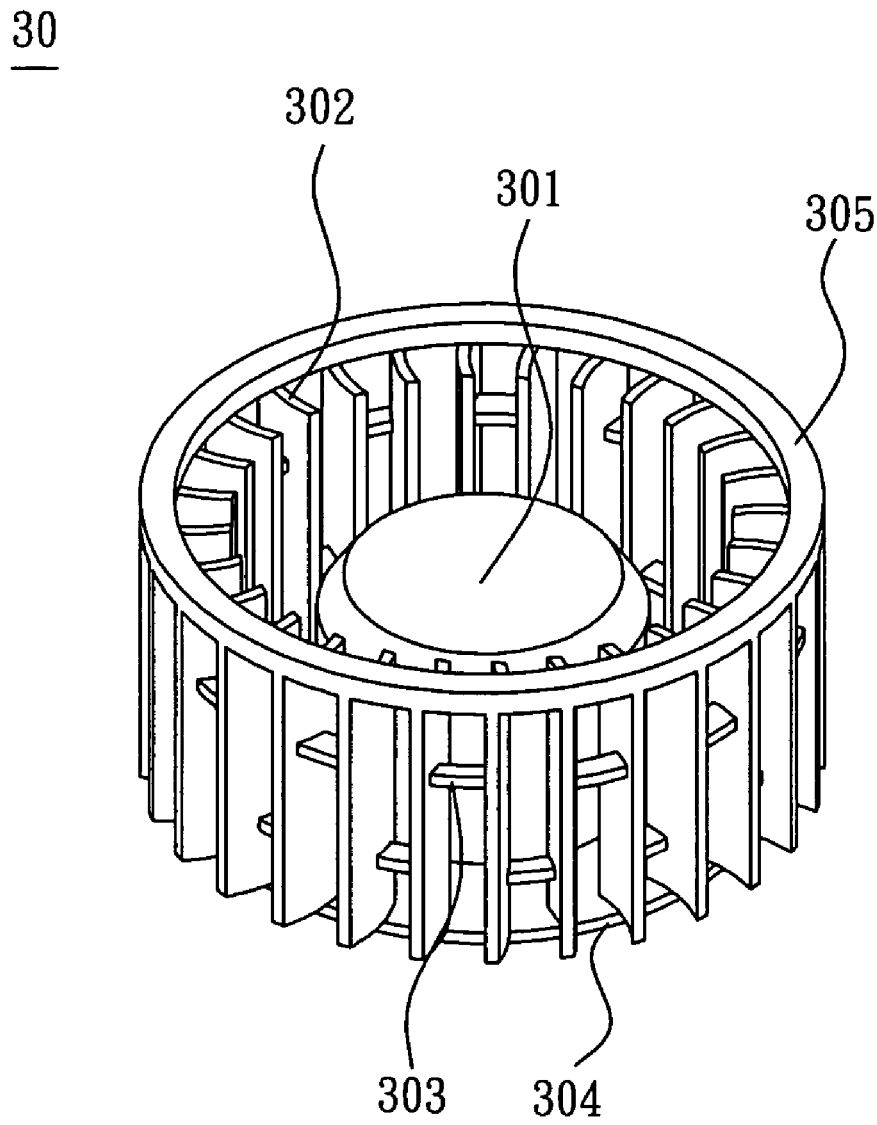
FIG. 3 is a schematic illustration showing an impeller according to an embodiment of the invention.
Figure 4:
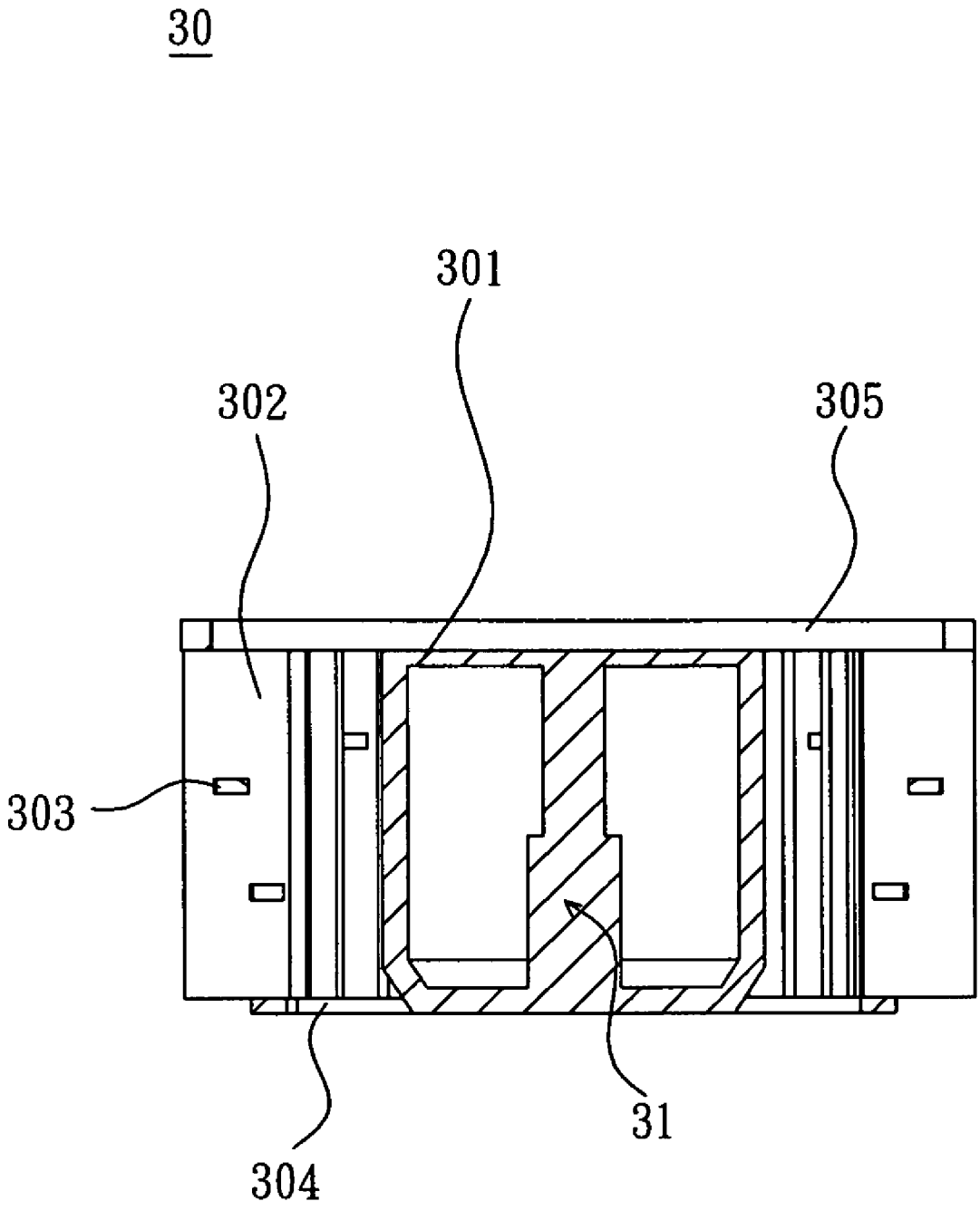
FIG. 4 is a sectional view of an impeller according to an embodiment of the invention.

Referring to FIG. 3 and FIG. 4, the impeller 30 comprises at least one reinforced element 303 on the active surfaces of the adjacent blades 302. Particularly, a reinforced element 303 (as shown in FIG. 3) can be disposed on the active surfaces of two adjacent blades 302. Herein, the blades 302 and the reinforced element 303 are integrally formed as a single piece or correspondingly wedged to each other. In this embodiment, the adjacent reinforced elements 303 can be disposed in radial or axial misalignment. The reinforced elements 303 may be a rib without restricted shape and size. Furthermore, the reinforced elements 303 may cross through the blades 302 or may not cross through the blades 302.

Figure 5:
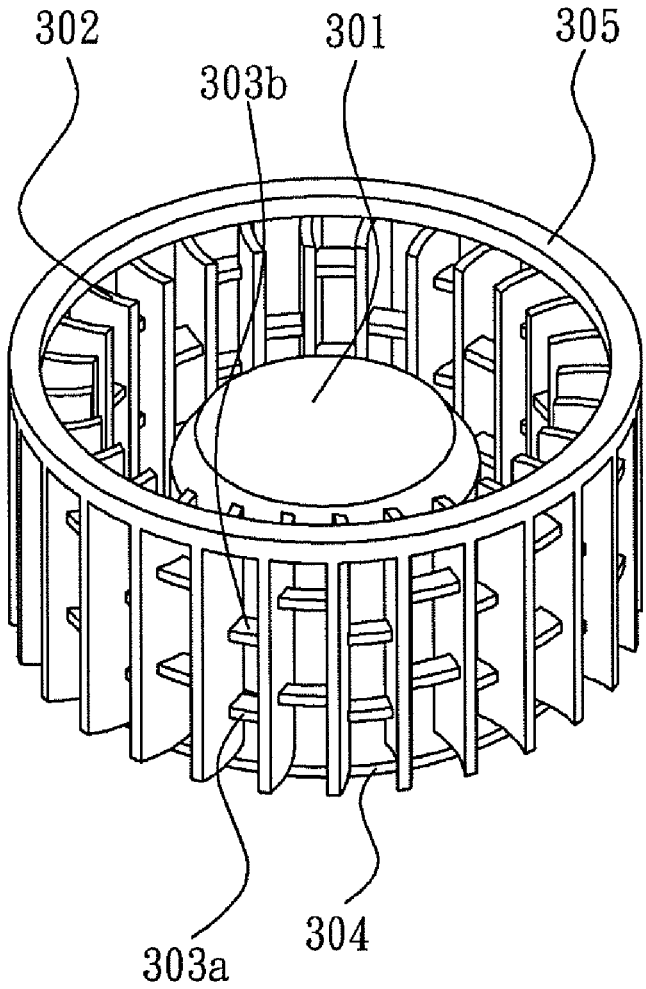
FIG. 5 is a schematic illustration showing an impeller according to another embodiment of the invention.

In addition, referring to FIG. 5, plural reinforced elements 303*a*, 303*b* can be disposed on the active surfaces of the adjacent blades 302. The reinforced elements 303*a*, 303*b* connecting to the same active surface can be disposed axial misalignment.

The impeller 30, 30' of the embodiment may further comprise a connecting portion 304, which connects the blades 302 to the hub 301. The connecting portion 304 is radially extended from the periphery of the hub 301 outwardly. The blades 302 are fixed to the connecting portion 304. In the embodiment, the connecting portion 304 is integrally formed as a single piece with the hub 301 and the blades 302. The connecting portion 304 is an arc structure, a plate structure or a structure with a circular rib.

The blades 302 can be made of plastic or metal. In addition, the blades 302 can be plate blades, forward leaning blades or backward leaning blades, and the cross section thereof can be arc, rod-like or wave-shaped.

With reference to FIG. 3 and FIG. 5, the blades 302 of the embodiment may further comprise a connecting ring 305 formed on their tops or bottoms to avoid pressure leaking and strengthen the structure. In the embodiment, the connecting ring 305 may be disposed in radial misalignment with the reinforced elements 303 or 303*a*.

In summary, the fan and impeller of the invention disposes at least one reinforced element on the active surfaces of the adjacent blades. In more detailed, one or more reinforced elements are disposed radially or axially between the adjacent blades. Herein, the reinforced elements can be located in misalignment and be integrally formed as a single piece with the blades to strengthen the structure of the blades. Compared with the prior art, since the reinforced elements are disposed on the active surfaces of the adjacent blades, the blades of the invention are unnecessary to be disposed inwardly under the condition of the same accommodation capacity. Thus, the fan of the invention can have larger blade area for providing larger airflow quantity and air pressure.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A fan, comprising:

an impeller comprising a molded hub, a plurality of molded blades and a plurality of molded reinforced elements, wherein the molded blades are disposed around the molded hub, at least one of the molded reinforced elements is disposed between active surfaces of any adjacent two of the molded blades horizontally, and the molded blades and the molded reinforced elements are formed as a single piece, wherein the molded reinforced elements are located in radial and axial misalignment, and there is a horizontal distance between the molded hub and the molded blades; and a motor connecting to the impeller for driving the impeller to rotate.

2. The fan according to claim 1, wherein when two or more than two of the molded reinforced elements are connected to the same active surface, the molded reinforced elements connected to the same active surface are located in radial and axial misalignment.

3. The fan according to claim 1, wherein the molded reinforced elements are ribs.

4. The fan according to claim 1, wherein the molded blades are made of plastic or metal.

5. The fan according to claim 1, wherein the cross section of each of the molded blades is arc, rod-like or wave-shaped.

6. The fan according to claim 1, wherein the molded blades are plate blades, forward leaning blades or backward leaning blades.

7. The fan according to claim 1, further comprising a connecting portion for connecting the molded blades to the molded hub.

8. The fan according to claim 7, wherein the connecting portion is radially extended from the periphery of the molded hub outwardly, and the molded blades are connected to the connecting portion.

9. The fan according to claim 7, wherein the molded hub and the connecting portion are formed as a single piece.

10. The fan according to claim 7, wherein the connecting portion is an arc structure, a plate structure or a structure with a circular rib.

11. The fan according to claim 1, wherein the impeller further comprises a connecting ring disposed on tops or bottoms of the molded blades.

12. The fan according to claim 11, wherein the connecting ring and the molded reinforced elements are located in radial misalignment.

13. The fan according to claim 1, further comprising a fan frame for accommodating the impeller therein.

14. The fan according to claim 1, wherein the molded reinforced elements cross through or do not cross through the active surfaces of the molded blades.

15. A fan, comprising:

an impeller comprising a molded hub, a plurality of molded blades and a plurality of molded reinforced elements, wherein the molded blades are disposed around the molded hub, at least one of the molded reinforced elements is disposed between active surfaces of any adjacent two of the molded blades, the molded reinforced elements do not cross through the active surfaces of the molded blades, and the molded blades and the molded reinforced elements are formed as a single piece, wherein the molded reinforced elements are located in radial and axial misalignment horizontally, and there is a horizontal distance between the molded hub and the molded blades; and a motor connecting to the impeller for driving the impeller to rotate.

16. An impeller, comprising:

a hub;

a plurality of blades disposed around the hub; and a plurality of reinforced elements, wherein at least one of the reinforced elements is disposed between active surfaces of adjacent two of the blades horizontally, and the blades and the reinforced elements are formed as a single piece, wherein there is a horizontal distance between the hub and the blades, and two immediately adjacent reinforced elements are misaligned along the axial direction of the hub, wherein the reinforced elements are located in radial and axial misalignment.

17. The impeller according to claim 16, wherein the reinforced elements cross through or do not cross through the active surfaces of the blades.

* * * * *